US006200662B1

(12) United States Patent
Mussallem, III

(10) Patent No.: US 6,200,662 B1
(45) Date of Patent: Mar. 13, 2001

(54) RUBBER COATED RUG UNDERLAY WITHOUT SCRIM

(76) Inventor: Charles S. Mussallem, III, 5830 Clifton Ave., Jacksonville, FL (US) 32211

( * ) Notice: Subject to any disclaimer, the term of this patent is extended or adjusted under 35 U.S.C. 154(b) by 0 days.

(21) Appl. No.: 09/413,167

(22) Filed: Oct. 7, 1999

(51) Int. Cl.[7] ..... B32B 3/02; B32B 33/00

(52) U.S. Cl. ..... 428/95; 428/90; 428/96; 428/167; 428/172; 428/179; 442/374

(58) Field of Search ..... 428/90, 95, 96, 428/141, 167, 172, 179, 180; 442/60, 374, 402

(56) References Cited

U.S. PATENT DOCUMENTS 4,360,554 * 11/1982 Campbell et al. ..... 428/91
4,504,537 * 3/1985 Mussallem ..... 428/91

* cited by examiner

*Primary Examiner*—Donald Loney
(74) *Attorney, Agent, or Firm*—Arthur G. Yeager

(57) ABSTRACT

A rug underlay formed of a compressed central mat of needle-punched waste or recycled fibers, the upper layer of which is heat fused by a drum to provide a chevron design of lands and grooves alternating between adjoining squares and a lower layer of elastomeric material coating the mat and embossed with a pattern of geometric formation.

5 Claims, 3 Drawing Sheets

RUBBER COATED RUG UNDERLAY WITHOUT SCRIM

BACKGROUND OF THE INVENTION

1. Field of the Invention

This invention relates to the field of underlays for rugs; and more particularly to the field of underlays for area rugs as distinguished from carpets that are fastened to the floor.

2. Description of Related Art

U.S. Pat. No. 4,504,537 to applicant, Charles S. Mussallem, Jr. teaches a rug underlay having a fiber batting needle-punched to a central stiffening lattice of heavy synthetic filamentary material; one of the two outside surfaces being treated to heat-fuse the fibers and rolled to a corrugated appearance and the other side being coated with a rubbery latex and rolled to provide an embossed grid pattern on the rubber coating.

BRIEF SUMMARY OF THE INVENTION

The present invention is an improved rug underlay made from a needle-punched fiber batting that does not include a stiffening lattice. The central core of the needle-punched batting is heat fused on one side and rolled to produce a pattern of ridges and valleys in a chevron formation, while the other side is coated with a rubber latex and embossed with a roller to impart a grid pattern onto the rubber. The heat-fused fibers of the first side are rolled to provide an overall checker-board design of ridges arranged in the style of chevrons oriented in the direction of travel of the users of the rug which is generally lengthwise of the underlay. Alternate squares of the checkerboard design exhibit the chevrons rotated 180 degrees from the direction of the neighboring square. Preferably, the central axis of each chevron corresponds to the general direction of travel of persons walking on the rug.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Area rugs, such as Oriental rugs, are frequently found in homes and in offices to beautify certain locations in rooms where a special piece of furniture is to be located, for example, where a favorite coffee table is located and the rug under the coffee table will provide an especially pleasing decorative background. Similarly, a beautiful desk might be accentuated by being centered on a rug placed over the carpeting of an office. In many instances, it is important to place a rug underlay under the area rug, and it is an object of this invention to provide such a rug underlay that may be placed directly on the wooden floor base or may be placed over a carpet and under the decorative area rug.

Figure 1:
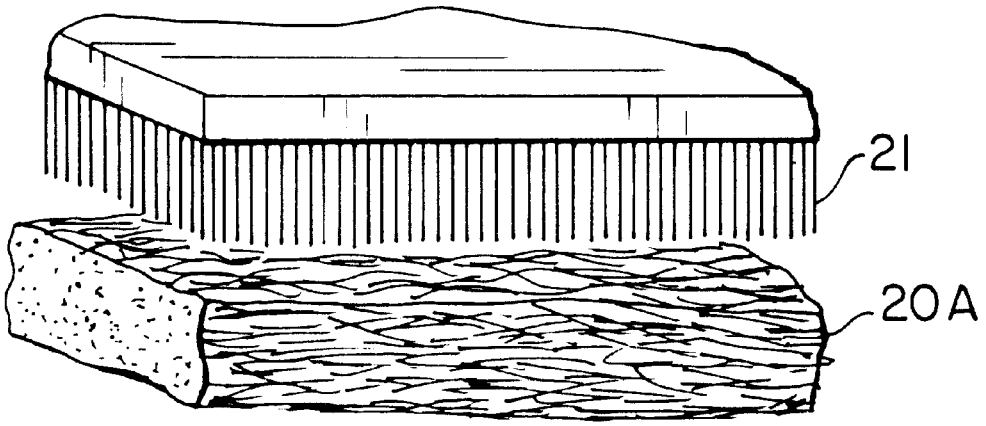
FIG. 1 is a perspective drawing of a compressed fiber batting being needle-punched to produce a core for use in making the underlay of this invention.

The underlay of this invention has a central layer of fiber batting 20A that has been needle-punched so as to prepare a core or layer 20B of tightly matted fiber with fibers from the top extending through and matted with fibers on the bottom, as well known in the art. The needle-punching is diagrammatically illustrated in FIG. 1. The fibrous core 20B after being needle-punched from one side through the batting, may be turned over and passed through a downstream needle-punching step thereby providing needle-punching from both sides of the batting. In any event, the central batting is made so the fibers of the batting are matted together more tightly to make the core more stable.

The batting may be made of any one or more types of fibers, although synthetic fibers are preferred, such as, polyamides, polyolefins, polyesters, polyacrylics, and copolymers and mixtures thereof. Wool and cotton are acceptable, of course, but the costs of these natural fibers are usually too high to compete favorably with the synthetic fibers.

One surface of the needle-punched core 20B is treated to fuse the fibers and provide stiffened fiber ends and shape the surface to be able to effectively grip the bottom of the overlying Oriental rug to maintain its position and inhibiting it from sliding over the base carpet or the floor. Preferably this fusing treatment is accomplished by appropriate heating to fuse the surface fibers, and rolling to give the fused fibers a ridged chevron appearance with stiffened fiber ends. These treatments are accomplished by passing the core of fibers under a heated roller that is at a sufficiently high temperature to cause partial fusing of the fibers at the surface of the mat, and the roller functions like a pressing iron to form the fibers into a final stiffened structure having a chevron appearance of ridges and alternating lands. Of course, the heated roller will have a surface that reflects the desired final design of the chevrons. It is preferred that the surface of the underlay has the functionality of chevrons with each stripe forming a ridge 28 of the chevron comprising fibers projecting outwardly from the surface while the spaces forming lands 38 between ridges or stripes 28 exhibit stiff fiber ends that do not project significantly outwardly of the ridge surfaces but do enhance the holding power of the area rug placed thereon, particularly when walked upon. This arrangement provides enhanced holding power against sliding of an area rug with respect to the underlay over a supporting carpet or a floor of wood, masonry, or the like. If an Oriental rug is employed to support and show a coffee table, the Oriental rug will be laid over the surface of the underlay having the fused-fiber and ridged chevron surface facing upwardly to contact the back of the Oriental rug, and the rubberized surface will be juxtaposed on top of and engaged with the basic carpet or directly on the floor in the absence of a carpet.

Figure 4:
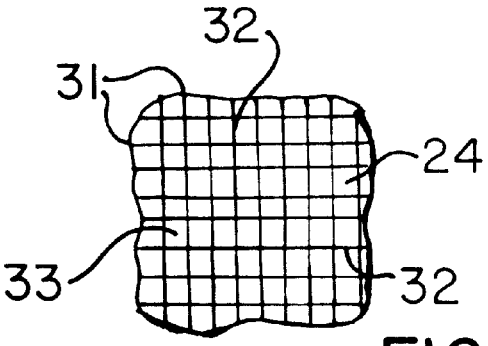
FIG. 4 is a plan view of the bottom of the rug underlay of this invention showing the embossed rubber coating in a grid design.

The lower surface of the underlay is expected to rest either on the floor of the room or on the carpet or rug covering the floor. In order to provide a soft cushioned feel underfoot and a nonslip contact with the floor, the lower outside layer of the underlay 20B is provided with a rubbery coating 24 embossed with a grid pattern 31 as having raised ribs 32 and flat rubber depressions 33, as shown in FIG. 4. The coating is a rubbery or elastomeric material, such as a synthetic latex material, natural latex material or a blend thereof which is generally applied to the underlay by foaming, pouring, spraying or brushing and then allowed to dry or cure partially, and then rolled to impart an embossed grid pattern 31 as shown in FIG. 4, and as well known in the art. The novelty in this invention lies primarily in the pattern of ridges and valleys on the upper surface of the underlay enhancing both stability of the underlay itself and the gripping of the area rug to maintain same in its desired position.

Figure 3A:
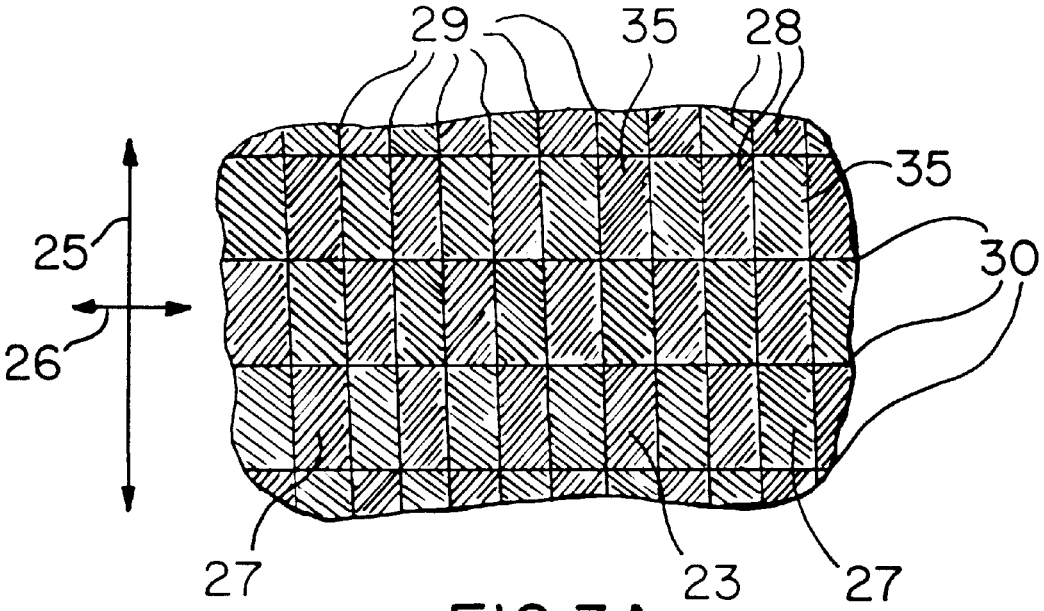
FIG. 3A is a plan view of the top of the rug underlay of this invention showing the fiber ridges and lands in a design of chevrons on the top surface.
Figure 3B:
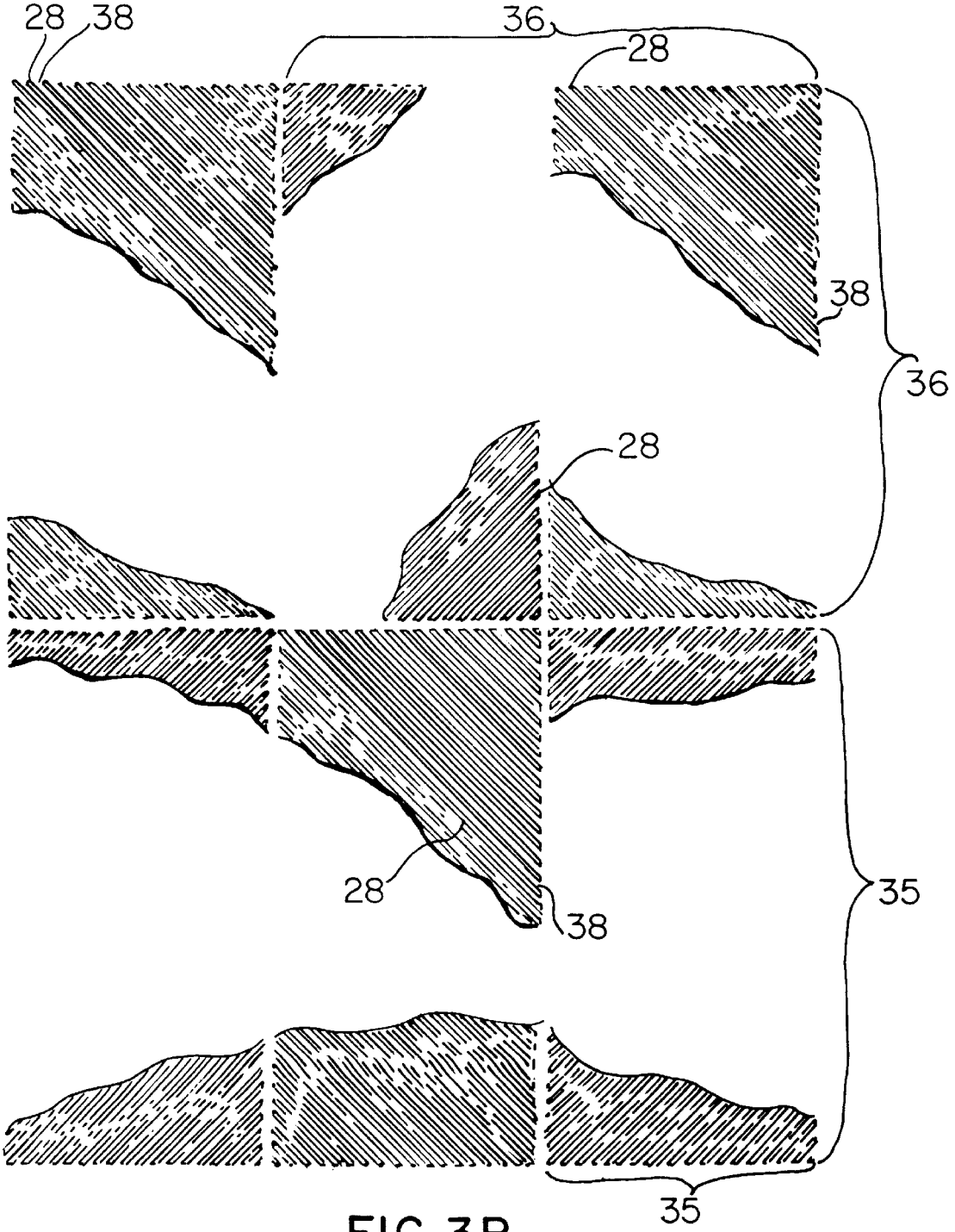
FIG. 3B is an enlarged view of a portion of FIG. 3A showing more details.

As seen in FIG. 3 of the drawings, the upper surface of the underlay is fashioned into a pattern of adjoined rectangles 35. The basic pattern is a checkerboard of squares 36, each square 36 being one foot on a side, and comprising two half-squares 35 oriented in the same travel direction 25, which is the general direction most persons usually would be expected to use in crossing the area covered by the underlay and the area rug. Half-squares 35 are joined on all sides with contiguous half squares 35, and the surface of each half-square 35 is formed by heat fusing and pressing the surface fibers into a series of parallel ridges 28 positioned at an angle of about 45 degrees from the travel direction 25. The direction of ridges 28 alternates from right to left (or left to right) as one passes from one half-square 35 to the next adjoining half-square 35. This arrangement produces alternating pairs of chevron patterns in adjoining squares 36, the chevrons all having their apexes pointing in the travel direction or generally along the length of the underlay, alternating up and down in adjoining squares 36. The ridges 28 of the chevron pattern 31 are positioned close together; approximately 40–70, preferably about 50, ridges per lineal foot measured at right angles to the direction of the ridges. A typical arrangement includes ridges 28 about 0.090 inch in width separated by lands 38 about 0.120 inch in width.

Figure 2:
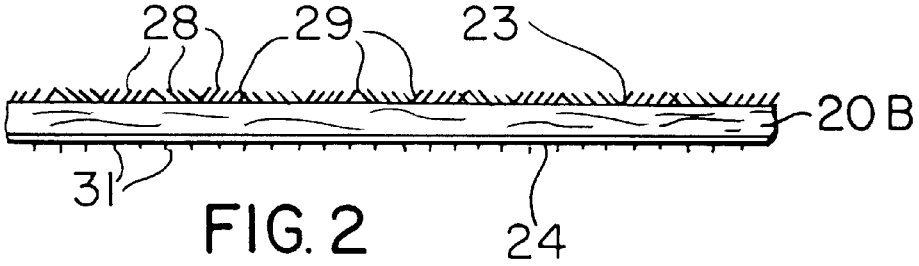
FIG. 2 is a diagrammatic cross-sectional view through the rug underlay of this invention.

The boundary areas or lines 29 are lands between half-squares 35 in the travel direction 25 which improves the stability of the underlay. It appears that the nonslip properties of the overlay are enhanced when at least boundary lands 29 are distinct in surface 24 of FIG. 2 perhaps due to the separation of the chevrons. The boundary areas or lines 30 are lands in the cross direction 26 and may be made at the same depth as lands 29 and/or lands 38. This invention is intended to cover an underlay as described above having a rolled, chevron-fashioned surface 23 of fused fiber ridges and lands on one side and a rubbery coating of ribs and depressions in a square grid design on the other side, or other geometric non-slip design which may even be the same as the top surface design. The chevron design includes grooves 29 delineating the squares and half-squares in the travel direction; and grooves 30 in the cross direction define the squares. Grooves 29 are about 0.090–0.110 inch in width, preferably 0.100 inch wide; while grooves 30 are 0.190–0.210 inch wide, preferably 0.200 inch in width.

Some of the distinct advantages of the underlay described above are the enhanced and stable foundation provided thereby for area rugs which inhibits excess lateral movement of the area rug due to walking and/or vacuuming of the area rug; the pattern on the upper surface providing a ready and easily determined size to cut for a particular area rug requiring no measurement and/or chalk line marking(s); and no expensive scrim to stabilize the underlay.

The underlay of this invention may have any of the generally standard weight per square yard and may be prepared in different thicknesses and/or compaction. Generally the thickness will be from one-quarter to one-half inch and the corresponding weight of the underlay will vary from about 28 ounces for the thinner underlay to about 48–60 ounces for the thicker underlay per square yard of material.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A rug underlay comprising a central layer of fiber batting needle-punched from at least one side of the batting to produce a thin fibrous core, said core having a lower surface and an upper surface, said upper surface being heated and compressed to form heat-fused fibers having prickly stiff outwardly extending fibers in a checkerboard arrangement of lands and grooves in a chevron design, said lower surface being coated with a layer of cured rubbery material embossed with a geometric design.

2. The rug underlay of claim 1 wherein said checkerboard arrangement has adjoining squares each divided into two half-squares joined along a central axis of said chevron pattern of said lands and grooves.

3. The rug underlay of claim 2 wherein said underlay includes length and width directions, said central axis being positioned to substantially coincide with said length direction.

4. The rug underlay of claim 2 wherein said adjoining squares are founded by a pair of elongated grooves on respective sides of each said half-squares parallel to said central axis.

5. The rug underlay of claim 4 wherein said adjoining squares each includes a groove extending in the direction perpendicular to said central axis.

* * * * *